United States Patent [19]

Bunnell

[11] 4,128,295

[45] Dec. 5, 1978

[54] ECCENTRIC BORE CONNECTING DEVICE

[75] Inventor: Edward D. Bunnell, Palm Harbor, Fla.

[73] Assignee: AMP Incorporated, Harrisburg, Pa.

[21] Appl. No.: 823,303

[22] Filed: Aug. 10, 1977

Related U.S. Application Data

[63] Continuation-in-part of Ser. No. 683,994, May 6, 1976, abandoned.

[51] Int. Cl.[2] ..... H01R 11/02

[52] U.S. Cl. ..... 339/274; 24/115 G

[58] Field of Search ..... 339/270, 274; 24/115 G

[56] References Cited

U.S. PATENT DOCUMENTS

| | | | |
|---|---|---|---|
| 1,141,882 | 6/1915 | O'Malley | 137/613 |
| 1,872,048 | 8/1932 | Thomas, Jr. | 285/40 |
| 1,989,861 | 2/1935 | Hixon | 339/274 |
| 2,074,393 | 3/1937 | Hixon | 339/274 |
| 2,121,984 | 6/1938 | Rieger et al. | 285/33 |
| 2,159,153 | 5/1939 | Hixon | 339/274 |
| 2,264,754 | 12/1941 | Hixon | 339/274 |
| 2,336,175 | 12/1943 | Hixon | 339/274 |
| 2,920,305 | 1/1960 | Gibson et al. | 339/272 |
| 3,125,397 | 3/1964 | McGrath | 339/272 |
| 3,235,944 | 2/1966 | Broske et al. | 339/247 |
| 3,280,856 | 10/1966 | Broske et al. | 339/247 |
| 3,329,928 | 7/1967 | Broske | 339/247 |
| 3,765,420 | 10/1973 | Felczak | 128/347 |
| 3,931,726 | 1/1976 | Grubb | 72/430 |

FOREIGN PATENT DOCUMENTS

| | | | |
|---|---|---|---|
| 28156 of | 1913 | United Kingdom | 285/178 |

OTHER PUBLICATIONS

Shur-Lok, T. M. Cable Conn., Ideal Ind.

*Primary Examiner*—Joseph H. McGlynn
*Attorney, Agent, or Firm*—Anthony S. Volpe

[57] ABSTRACT

Connecting device which is intended to be installed on a conductor comprises rotatable male and female parts having conductor receiving bores extending therethrough. The bores are eccentric relative to the axis of rotation of the parts so that the opening defined by the bores is constricted when the parts are rotated relative to each other thereby to establish an electrical connection with the conductor. The invention is characterized by its simplicity, ease of manufacture, and by the fact that it can be applied to the conductor without the need of specialized tools.

10 Claims, 7 Drawing Figures

ECCENTRIC BORE CONNECTING DEVICE

CROSS REFERENCE TO RELATED APPLICATION

This is a continuation-in-part of prior co-pending application Ser. No. 683,994 filed May 6, 1976, now abandoned.

BACKGROUND OF THE INVENTION

This invention relates to electrical connecting devices of the type comprising two parts which have a conductor-receiving bore means extending therethrough and which can be rotated relative to each other. The bores in the two parts are such that the opening through the device, which is defined by the bores, is constricted when the parts are rotated so that a high pressure electrical contact is established between the connecting device and the conductor. Connecting devices of this general class are shown, for example, in U.S. Pat. Nos. 2,336,175, 2,159,153, 1,989,861 and in United Kingdom specification 28,153 AD 1913, which has an accepted date of Nov. 12, 1914.

Connecting devices of the eccentric bore type have been proposed in numerous prior patent publications. However, connecting devices of this general type are not in wide-spread use at this time, possibly because of the complexity or manufacturing cost of these prior devices and/or the absence of a certification feature in them. The term "certification feature" is herein used with reference to a feature which ensures that a sound electrical connection has been made after the device has been applied to a conductor. The general principles of connecting devices of this eccentric bore type are, however, sound and highly attractive, particularly in view of the fact that a device of this type can be assembled to a conductor at a worksite without the need of a specialized installing tool. The instant invention is directed to the achievement of an improved eccentric bore type connecting device which can be manufactured at a modest cost and which can be easily applied to a conductor with the aid of a pair of conventional wrenches. The invention is further directed to the achievement of a device which has a self-contained certification feature such that a brief inspection of the device after installation will reveal whether or not a sound electrical connection has been achieved.

This invention relates generally to the use of eccentric bores in rotary members to establish an electrical termination with a standard electrical wire. The electrical termination is established by the action of rotational or torsional shearing forces in addition to transverse shearing forces to produce a cold weld between adjacent strands as well as between the wire and the terminal body itself. This invention is especially, although not exclusively, intended for use with stranded aluminum cable of the type used in the utility industry. The terminal body comprises a female part and a male part having a plug received within a counterbore in the male part. Bores in both the male and female parts are offset with respect to the axis of rotation. Retaining means secure the two body parts against axial forces during termination and interacting stops limit rotary travel.

Among the objects of this invention are the achievement of an improved electrical and mechanical termination for stranded wire. This invention achieves this object by subjecting the strands to rotational and transverse shear forces to more effectively abrade the surface and remove oxide films from the strands. Cold welds forming metal-to-metal contact between the individual strands result in a good electrical termination with the entire cable and not just between the terminal and the outer strands which are more subject to being severed by transverse shear forces.

Another object of the invention is to provide an improved eccentric bore type connecting device. A further object is to provide a device having a minimum number of parts which can be manufactured at a low cost. A further object is to provide a device which is supplied to the user in assembled form and which cannot be disassembled as a result of carelessness or ordinary handling. A further object is to provide a connecting device which can be installed on a cable by a technician without specialized training in a very short time.

These and other objects of the invention are achieved in a preferred embodiment thereof which is briefly described in the foregoing abstract, which is described in detail below and which is shown in the accompanying drawing in which:

FIG. 5 is an end view looking in the direction of the arrows of 5—5 of FIG. 4.

Figure 1:
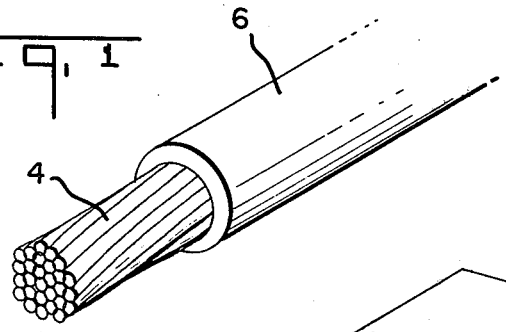
FIG. 1 is a perspective view of the end portion of an electrical cable.
Figure 2:
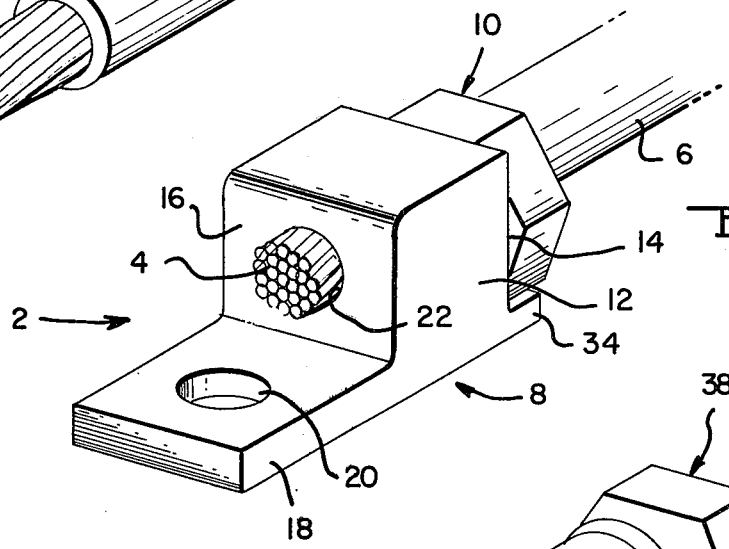
FIG. 2 is a perspective view of a connecting device in accordance with the invention installed on the end of a cable.
Figure 3:
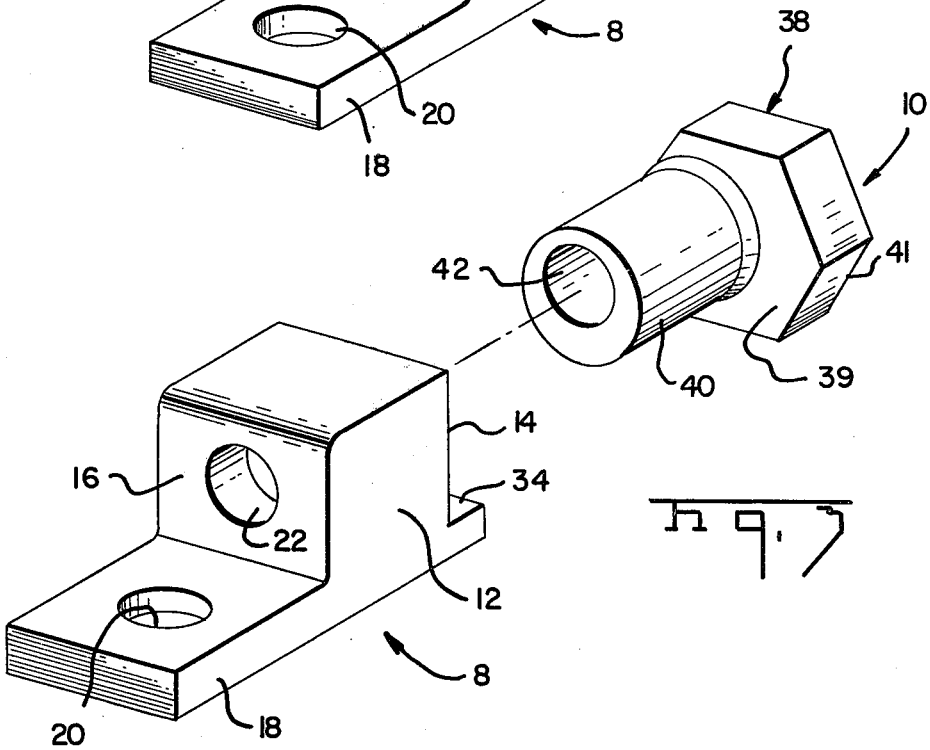
FIG. 3 is an exploded perspective view of the connecting device.

The herein disclosed embodiment of the invention comprises a terminal 2 which is intended to be secure to the conductors 4 of a cable 6. The invention is particularly useful for relatively heavy gauge cables such as aluminum or copper cables of size AWG 6 through 500 MCM (thousand circular mills).

The terminal 2 comprises a female part 8 and a male part 10, these parts being assembled to each other and being rotatable relative to each other as will be described below. The female part 8 has a block or body portion 12 having oppositely facing sides 14, 16. A tongue 18 extends from the side 16 and a hole 20 is provided in this tongue for reception of a stud, screw or bolt extending from a terminal on an electrical device such as a generator, motor, electrical bus bar or similar device.

A conductor receiving bore 22 extends into the body section 12 from the side 16 thereof, the diameter of this bore being substantially equal to, and slightly greater than the diameter of the conducting core 4 of the cable 6. A counterbore 24 extends inwardly from the side 14 and communicates with the inner end of bore 22 at a location between the two sides 14, 16. The axis of the counterbore is offset downwardly as viewed in FIGS. 4 and 5 from the axis of the bore 22. Advantageously, a radius 26 is provided at the intersection of a bore 22 and counterbore 24 in order to prevent shearing of any strands of the conductor 4 as will be described below. The entrance of the counterbore 24 is advantageously flared as shown at 30 to facilitate assembly of the parts as will also be described below. A lip 34 extends from the side 14 and from the bottom surfaces 35 of the body portion. This lip which extends entirely across the side 14 has a centrally located arcuate recess as shown at 36.

Figure 4:
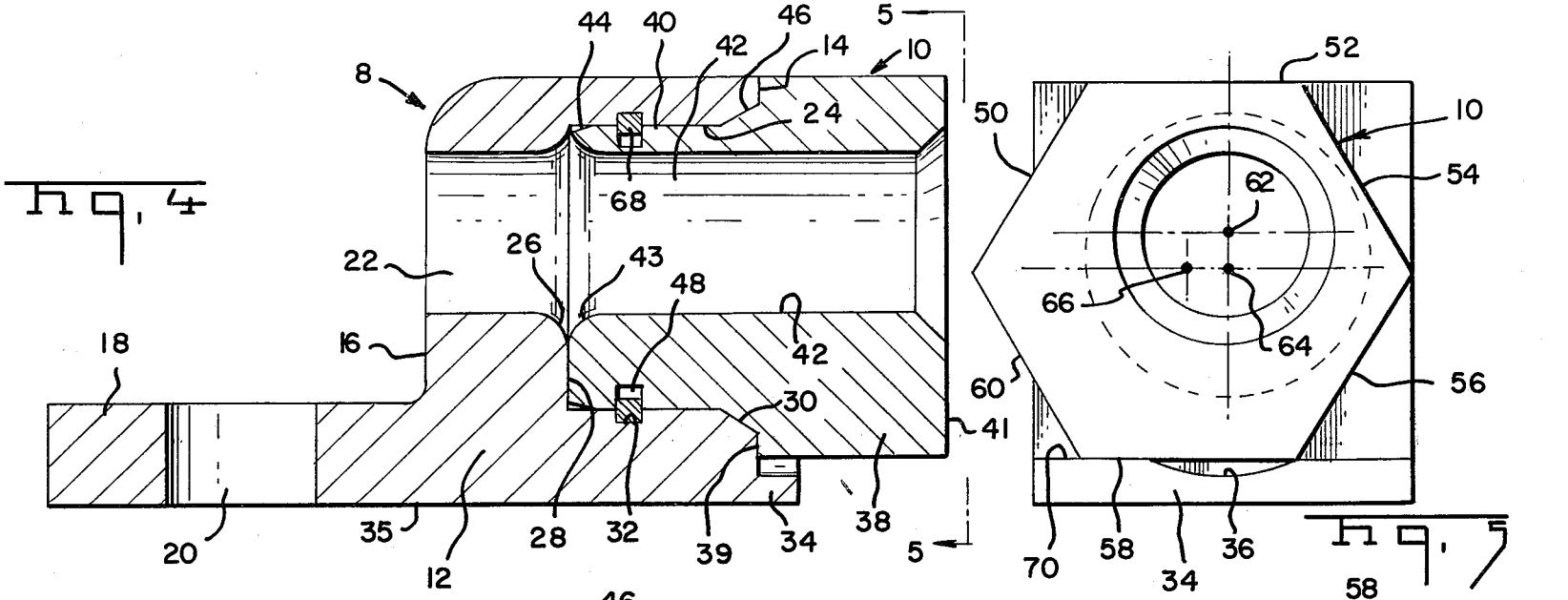
FIG. 4 is a transverse cross-sectional view of the connector showing the positions of the parts prior to installation of the device on the cable.

The male part 10 has a body portion 38 from which a cylindrical plug 40 extends on one side 39 thereof. A bore 42 extends from the side 41 of male part 10 through the body portion and through the plug section 40, the diameter of this bore being the same as that of the bore 22. It will be noted that the axis of the bore 42 is offset in a vertical direction from the axis of the plug portion 40 of male part 10. The leading end of the plug portion is beveled as shown at 44 to facilitate assembly of the parts and an internal radius 43 is provided adjacent to this leading end for the purpose of preventing shearing of the conductor during use. A fillet 46 is provided at the base of the plug portion in order to prevent stress concentration and so that there will be no internal voids in the assembled device as shown in FIG. 4.

The body portion 30 has the cross-section of a regular polygon having sides 50, 52, 54, 56, 58 and 60. As shown in FIG. 5, the center 66 of this polygon is located to the left (as viewed in FIG. 5) of the center 64 of the plug portion 40 of the male part. The center 62 of the bore 42 in the male part is in vertical alignment with the center 64 and above the center of the plug portion when the male part 10 is oriented as in FIG. 5.

Figure 6:
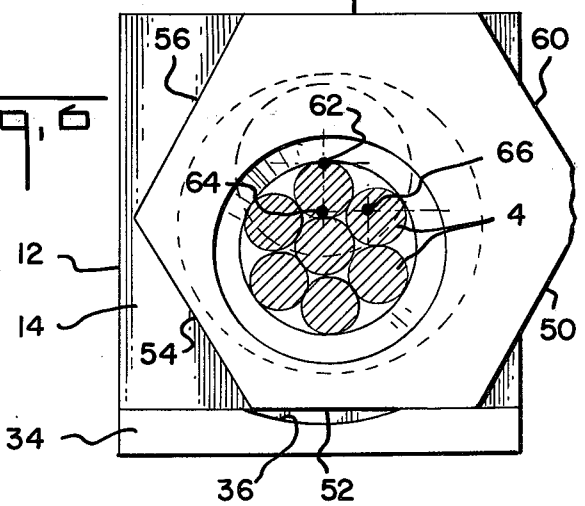
FIG. 6 is a view similar to FIG. 5 but showing the positions of the parts after installation of the part on the cable.
Figure 7:
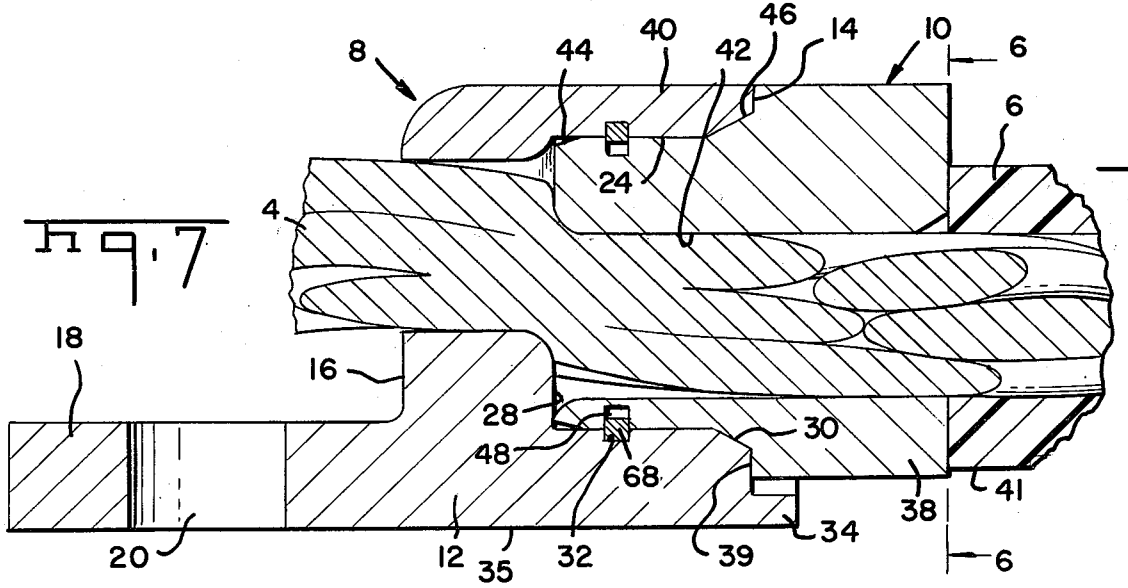
FIG. 7 is a view similar to FIG. 4 but showing the positions of the parts after installation of the device on the cable.

The male and female parts are assembled to each other by positioning a split ring 68 in a circumferential recess 48 in plug portion 40 and moving the plug portion into the counterbore 24 until the ring 68 snaps into a circumferential recess 32 in the counterbore. When this assembly step is carried out, the parts should be oriented such that the side 58 of the body portion 38 will be against, or adjacent to, the surface 70 of the lip 34. It will be apparent from FIG. 5 that the parts are dimensioned such that the apex between the sides 56 and 58 will then be located on the right hand side of the arcuate recess 36 in lip 34. The two parts are supplied to the user in this condition so that the male part can be rotated through an angle of substantially 180° until they are in the position of that shown in FIG. 6.

In use, the end of the conductor is stripped of its insulation and the conducting core is inserted through the aligned bores 42, 22. The technician then merely rotates the male part relative to the female part through an angle of 180° until the side 52 is against the surface 70. After such rotation, further rotation of the parts is impossible because of the fact that the apex between the sides 52, 50 is located rightwardly of the recess 36.

During rotation of the parts relative to each other, the passageway defined by the aligned bores 22, 42 is greatly constricted at the inner end 28 of the counterbore 24 and the conducting core 4 is drastically deformed and compressed in this zone. As a result, a high pressure electrical connection is provided between the connecting device and the conductor.

The radii 26 and 43 provide smooth transition surfaces for the conductor in this transition zone so that the strands of the conductor will not be parted, even if the conductor contains very fine aluminum wire strands.

During the rotation of male part 10 relative to female part 8, the inner surfaces of both eccentric bores exert both a transverse shear and a rotational or torsional shear on the constituent strands 4 of cable 6. Both shear modes cause the strands 58 to move relative to each other. Initially, this shear causes the strands to compact, but deformation of the strands soon begins. The rotational shear and relative movement of the strands under the force exerted by the constricting body members results in a scraping or abrasive action which should be transmitted through most of the strands in the cable. The scraping action separates the relatively brittle oxide coating which forms on an aluminum conductor from the underlying metal. As the constriction of the cable continues intimate contact is formed between metal surfaces of adjacent strands as well as between the outer strands and the terminal body members. The electrical contact formed by the presence of the rotational shearing mode is therefore better than that formed by the action of transverse forces alone.

A significant advantage of the invention is that the connecting device is comprised of only three parts, if the snap ring 68 is included, and the parts are supplied to the user in assembled form so that they cannot be lost or mismatched. Installation of the device on a conductor is an extremely simple operation and can be carried out with open end wrenches by an unskilled technician at a worksite. Furthermore, the electrical connection can be inspected by merely noting the position of the male member on the terminal. If the parts are in the position of FIG. 6, one can be assured that the device has been properly applied to the wire conductor.

While the invention is herein disclosed as a conventional terminal lug, it will be apparent that the principles can be used in a variety of connecting devices, for example, splicing devices for connecting the ends of two cables or commoning blocks for connecting two or more cables at a common point.

I claim:

1. An electrical connecting device consisting of:

a male connector part and a female connector part, said female part having a female part bore and a female part counterbore extending therethrough, said female part counterbore being offset with respect to said female part bore, said male part having a body portion and a plug portion extending therefrom, said plug portion being rotatably disposed in said female part counterbore, retaining means serving to retain said plug portion in said female part counterbore, said retaining means permitting rotation of said parts relative to each other, a male part bore extending through said body portion and said plug portion of said male part, said male part bore having an axis which is offset with respect to the axis of said plug portion, said male and female parts being in a rotational orientation such that said male part bore is in axial alignment with said female part bore and, external stop means effective between said male part and said female part, said stop means permitting rotation of said parts relative to each other through a predetermined angle and preventing rotation beyond said angle, said stop means comprising an axial projection on one of said parts which extends partially past the other one of said parts parallel to the axes of said bores, and a radial projection on the other one of said parts, said projections being engageable with each other after rotation of said parts whereby, upon insertion of a cable through said bores and rotation of said parts relative to each other through said angle, said cable is deformed in a rotational shear mode at the inner end of said female part counterbore and surface portions of said cable are electrically contacted with internal surface portions of said connecting device.

2. A connecting device as set forth in claim 1, said stop means comprising an axially projecting lip on said female part, said lip extending parallel to the axis of said bores past said male part, said male part having a radially projecting portion which engages portions of said lip after rotation of said parts.

3. A connecting device as set forth in claim 1, said body portion having the cross-section of a regular polygon with the center of said polygon being offset relative to the axis of said plug portion, said female part having a projecting lip which extends beside one side of said body portion, said lip having a recess on its surface which is opposed to said body portion, said recess permitting movement therethrough of the apices of said body until said parts have been rotated.

4. A connecting device as set forth in claim 1, said body portion of said male part having the cross-section of a regular polygon with the center of said polygon being offset relative to the axis of said plug portion, said female part having a projecting lip which extends beside one side of said body portion, said lip having a recess on its surface which is opposed to said body portion, said recess permitting movement therethrough of the apices of said body portion until said parts have been rotated through said angle of 180° whereby said lip constitutes said stop means.

5. An electrical connecting device consisting of:

a male connector part and a female connector part, said female part having a female part bore and a female part counterbore extending therethrough, said female part counterbore being offset with respect to said female part bore, said male part having a body portion and a plug portion extending from said body portion, said plug portion being rotatably disposed in said female part counterbore, retaining means serving to retain said plug portion in said female part counterbore, said retaining means comprising aligned circumferential recesses in said female part counterbore and on said plug portion, a split retaining ring in said recesses whereby said male and female parts can be rotated relative to each other, a male part bore extending through said body portion to each other, said plug portion, said male part bore having an axis which is offset with respect to the axis of said plug portion, said male and female parts being in a rotational orientation such that male part bore is in axial alignment with said female part bore, said body portion of said male part having the cross-section of a regular polygon with the center of said polygon being offset relative to the axis of said plug portion, said female part having a projecting lip which extends beside one side of said body portion, said lip having a recess on its surface which is opposed to said body portion, said recess permitting movement therethrough of the apices of said body portion until said parts have been rotated through an angle of 180° and preventing further relative rotation of said parts whereby said lip constitutes a stop means for said parts whereby, upon insertion of a cable through said bores and upon rotation of said parts relative to each other through an angle of 180°, said cable is deformed at the inner end of said female part counterbore and surface portions of said cable are electrically contacted with internal surface portions of said connecting device.

6. A connecting device as set forth in claim 5, said device being in the form of a terminal having a tongue extending from said female part.

7. An electrical connector assembly, for use with an electrical conductor comprising a female connector member and a male connector member mutually rotatable between a first position and a second position:

(a) said female connector member comprising an electrically conductive first body member and further comprising:

(i) a female bore in said first, female body member extending partially therethrough, (ii) a counterbore in said first body member, said counterbore extending inwardly from a first face of said first body member, the axis of said counterbore being offset from the axis of said female bore, (iii) first retaining means extending at least partially around the internal circumference of said counterbore, (iv) external stop means extending from said first face of said first body member, (b) said male connector member comprising an electrically conductive second male body member and further comprising:

(i) an exterior portion on said second body member having a first external surface which abuts said external stop means when said assembly is in said first position, thereby permitting rotation in one direction only, and a second external surface which abuts said external stop means when said assembly is in said second position, thereby preventing further rotation in said one direction, (ii) an interior plug portion extending from said exterior portion, said interior plug portion being dimensioned for receipt by said counterbore, (iii) a male bore extending through said male second body member, the axis of said male bore being offset from the axis of said plug portion, the axis of said male bore being in alignment with the axis of said female bore when said assembly is in said first position and offset therefrom when said assembly is in said second position, and (iv) second retaining means on said plug portion for engaging said first retaining means to retain said plug portion within said counterbore under the influence of axial forces, whereby said electrical conductor may be positioned within said aligned male and female bores when said assembly is in said first position and mechanical and electrical contact can be established with said conductor by rotation of said male and female connector members to said second position.

8. An electrical interconnection comprising: an aluminum wire further comprising a plurality of strands, and an aluminum terminal further comprising first and second body members, first and second adjacent portions of said aluminum wire being received respectively by said first and second body members, said plurality of strands being inelastically deformed to establish intimate contact among said strands, and between said strands and said first and second body members at an interface between said first and second body members, said first body member comprising a generally cylindrical plug member generated around a first axis with a first eccentric bore having a second axis offset from said first axis, for receiving said first portion of said aluminum wire, said second body member having a generally cylindrical cavity generated about a third axis for receiving said cylindrical plug member with said first axis and said third axis in alignment, and a second eccentric bore having a fourth axis offset from said third axis for receiving said second portion of said aluminum wire when said first axis is aligned with said fourth axis, said first member being rotatable relative to said second member to offset said first and second eccentric bores and subject said aluminum wire to transverse and rotational shear stress exerted by the inner surfaces of said first and second eccentric bores to inelastically deform said aluminum wire and to establish intimate contact at said interface.

9. An electrical interconnection as set forth in claim 8 wherein the diameter of said first eccentric bore is substantially equal to the diameter of said second eccentric bore.

10. An electrical interconnection as set forth in claim 9 wherein the diameter of said first and second eccentric bores is subsequently equal to and slightly greater than the diameter of said aluminum wire.

* * * * *